United States Patent [19]

Nicolas

[11] Patent Number: 4,706,322

[45] Date of Patent: Nov. 17, 1987

[54] ORTHODONTIC TOOTHBRUSH

[76] Inventor: Yvon M. Nicolas, 38, rue Penn ar Roz, 29119 Chateaunef-du-Faou, France

[21] Appl. No.: 911,049

[22] Filed: Sep. 23, 1986

[30] Foreign Application Priority Data

Sep. 23, 1985 [FR] France ..... 85 14161

[51] Int. Cl.[4] ..... A46B 9/04

[52] U.S. Cl. ..... 15/106; 15/167 R; 132/92 R

[58] Field of Search ..... 15/167 R, 167 A, 106, 15/110; 128/62 A; 132/89–93

[56] References Cited

U.S. PATENT DOCUMENTS

| | | | |
|---|---|---|---|
| 2,168,964 | 8/1939 | Strasser | 15/167 R |
| 3,229,318 | 1/1966 | Clemens | 15/167 R |
| 3,722,020 | 3/1973 | Hills | 15/167 R |
| 3,850,182 | 11/1974 | Clark, Jr. | 132/92 R |
| 4,572,223 | 2/1986 | Rosenfeld | 15/167 R |

FOREIGN PATENT DOCUMENTS

| | | | |
|---|---|---|---|
| 667510 | 7/1963 | Canada | 128/62 A |
| 324623 | 11/1957 | Switzerland | 15/167 R |

*Primary Examiner*—Peter Feldman

*Attorney, Agent, or Firm*—Thomas S. MacDonald; Alan H. MacPherson; Paul J. Winters

[57] ABSTRACT

The present invention relates to an orthodontic toothbrush, particularly for children wearing regulating pins, characterized by a brushing head (30) comprising on the one hand two lateral and longitudinal groups of tufts of bristles (31,35), each group possessing tufts (32,36) inclined towards the outside of the brushing head and diverging relative to a median longitudinal plane of the head, and tufts (33,37) converging towards this median longitudinal plane, and secondly at least one central longitudinal row of shorter tufts (40) parallel to the median longitudinal plane.

10 Claims, 8 Drawing Figures

ORTHODONTIC TOOTHBRUSH

Figure 1:
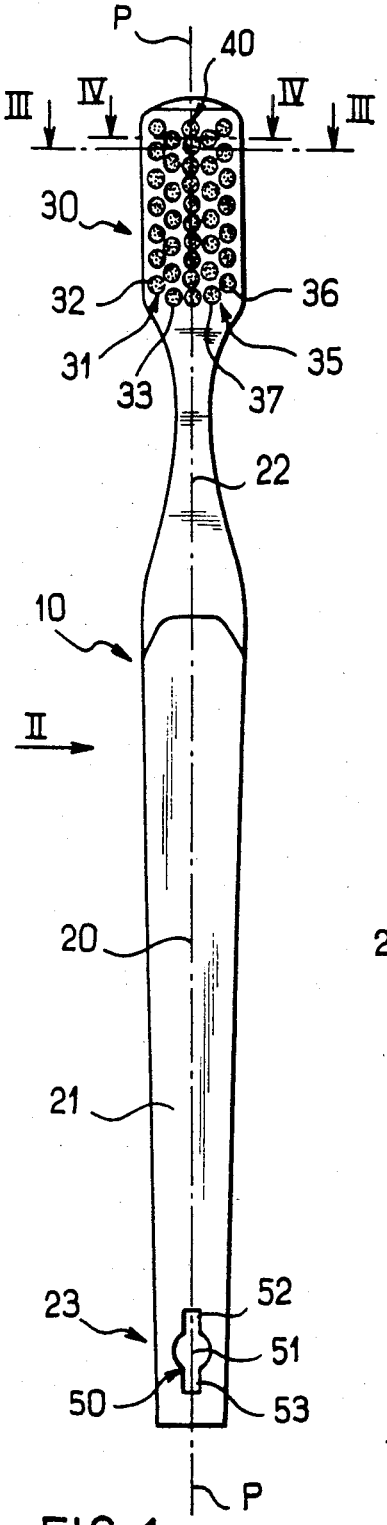

The present invention relates to the field of toothbrushes.

The present invention relates, more precisely, to an orthodontic toothbrush intended to be used in particular by children wearing regulating pins.

It is known that the techniques referred to as orthodontics and dento-facial orthopaedics which make use of fixed therapeutic devices intended to correct irregularities of the teeth are now frequently used in children.

These fixed therapeutic devices require anchoring means, which will be referred to herein by the term regulating pins, which are attached to the teeth,l and to bands, generally of metal, which pass through these pins and are designed to displace the teeth.

The above-mentioned anchoring means may be either stuck directly onto the teeth (more precisely onto the dental crowns) or attached to rings fixed over the teeth.

The result of all these attachments to the teeth is, in practice, that the bacterial plaque responsible for caries is more difficult to eliminate.

Contrary to a theory which has sometimes been expounded, neither the rings nor the regulating pins are responsible for provoking dental caries.

The latter results solely from the difficulty of brushing the teeth during orthodontic treatment, due to the presence of the regulating pins and of the bands.

Although numerous types of toothbrushs have already been proposed, none of the brushes currently available on the market has solved the problem thus posed.

Practitioners have attempted to restrict the development of dental caries in children wearing regulating pins by advising these children to use, in addition to the conventional brush, dental jets which spray water under pressure onto and between the teeth.

Nevertheless, these dental jets, though they may dislodge substantial food residues remaining between the teeth, do not remove the bacterial plaque, which can be eliminated only by brushing and which is, as indicated above, responsible for the appearance of dental caries.

Moreover, from U.S. Pat. No. 3,978,852, an electromechanical (vibrating) toothbrush is already known which has a head bearing tufts of pointed bristles designed to penetrate the crevices between the teeth and, where relevant, beneath the bands of the regulating pins. The brushing of the spaces accessible to the tufts is achieved by a reciprocal movement of the brushing head, in a direction parallel to the bristles. An arrangement of this kind cannot therefore be used for a manual toothbrush, in which case the brushing movement is made in a direction substantially perpendicular to the bristles.

A toothbrush is likewise known, from French Pat. No. 830,801, which possesses a brushing head provided with several rows of bunches of bristles—or tufts—some of which are inclined outward and others inward; this particular arrangement, the purpose of which is to improve the effectiveness of cleaning and to avoid injury to the gums, is in no way designed to facilitate brushing of the teeth when regulating pins are present, or to permit brushing of these pins themselves.

The present invention now brings an improvement to the situation by proposing an orthodontic brush characterized by a brushing head possessing, first, two lateral and longitudinal groups of tufts of bristles, each group comprising tufts inclined towards the outside of the brushing head, diverging relative to a median longitudinal plane of the head, and tufts converging towards this median longitudinal plane, and secondly at least one central longitudinal row of tufts of shorter bristles, parallel to the median longitudinal plane.

In particular, a toothbrush of this kind makes it possible, without imposing a specific brushing movement (and this is important to the extent that young children frequently wear regulating pins) to reach and brush correctly the cervix of the teeth, the junction between rings or bases of the dental pins, and the zone of the interdental papilla, which represent the most difficult areas to clean with conventional brushes and are thus the areas most subject to caries.

According to another important feature of the present invention, the difference in length between the bristles of the lateral groups and the bristles of the central row is substantially equivalent to the thickness of the regulating pins, and is preferably of the order of 2 mm.

Preferably, according to the invention, the axes of all the tufts are contained within transverse planes perpendicular to the said median longitudinal plane and to the mean surface of the head bearing the tufts.

According to a preferential embodiment of the present invention, eaoh lateral group of tufts comprises two longitudinal rows of tufts which diverge and converge respectively relative to the median longitudinal plane of the brushing head.

Moreover, according to the present invention, the end of the handle opposite the brushing head is advantageously designed to carry, in a removable fashion, accessories for dental hygiene, in particular accessories such as interdental brushes or supports for dental floss.

Figure 2:
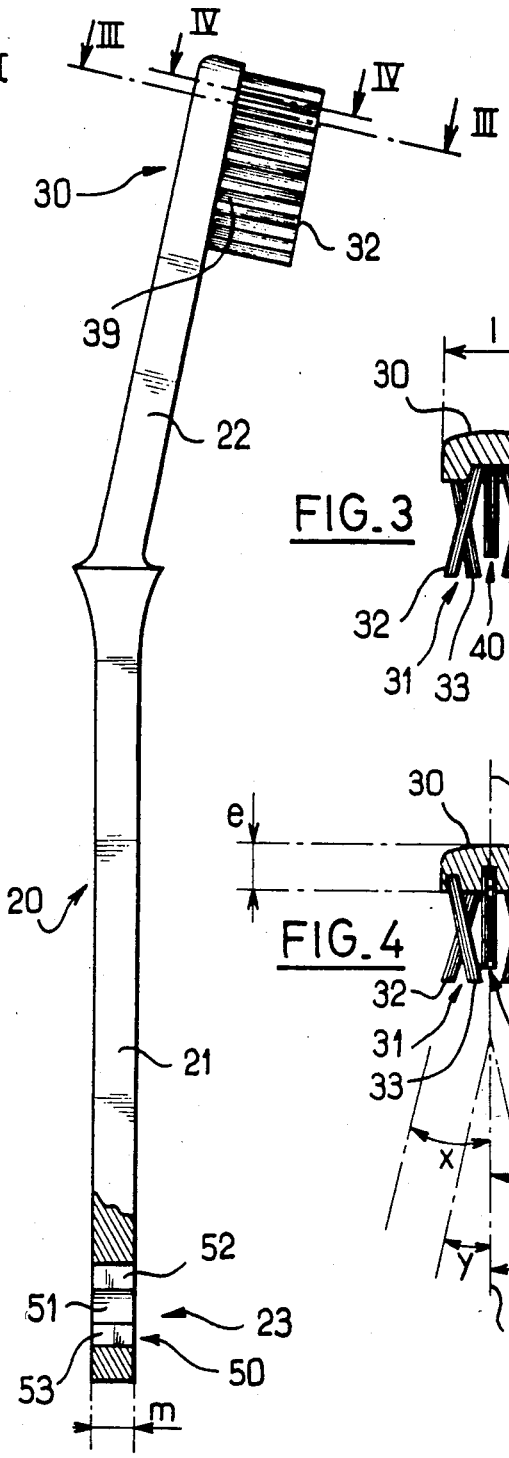
Figure 3:
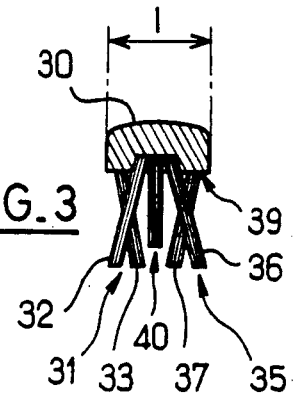
Figure 4:
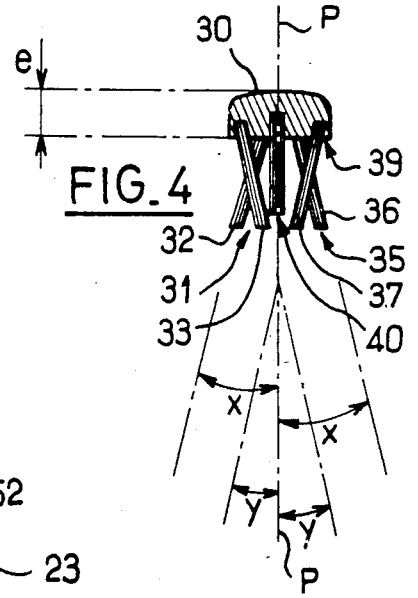
Figure 5:
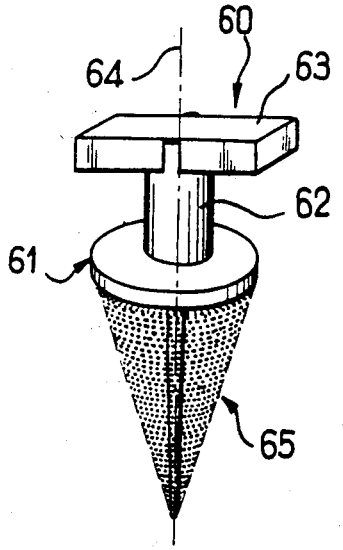
Figure 6:
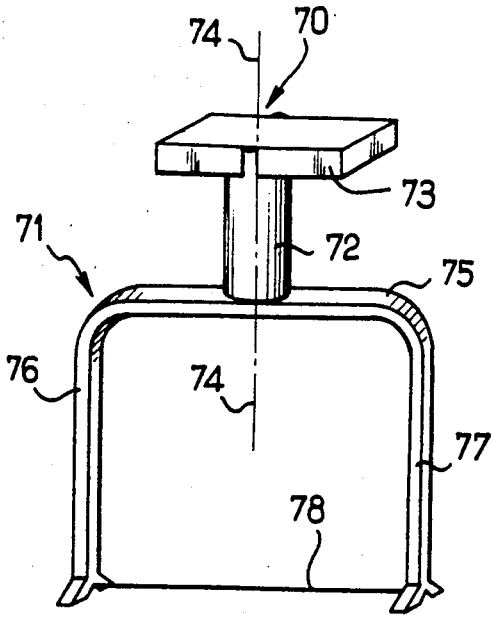
Figure 7:
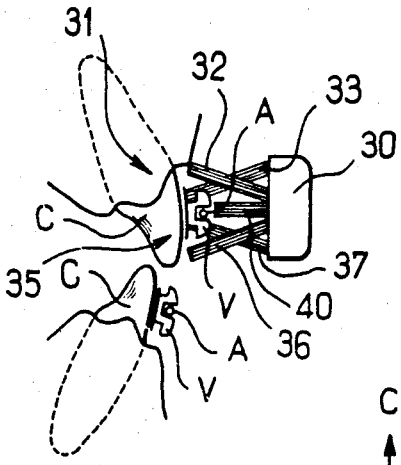
Figure 8:
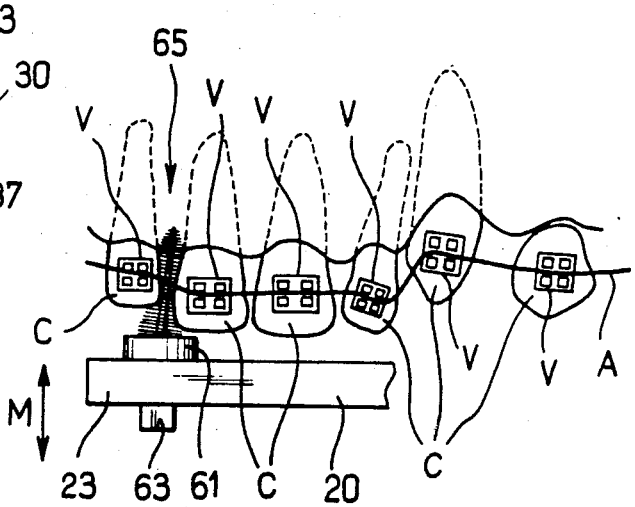

Other characteristics and advantages of the present invention will become apparent on reading the detailed description which follows and with reference to the attached drawings given by way of a non-limiting example, wherein:

FIG. 1 shows a diagrammatic plan view of a toothbrush according to the present invention, FIG. 2 shows a lateral view of the same toothbrush, according to a view illustrated by the arrow marked II in FIG. 1, FIGS. 3 and 4 show diagrammatic views of the brushing head of the same toothbrush, according to transverse sectional planes marked III—III and IV—IV, respectively, in FIGS. 1 and 2, FIGS. 5 and 6 show two accessories (interdental brush and floss support respectively) capable of being attached to the end of the handle opposite the brushing head, FIG. 7 illustrates diagrammatically the operation of brushing a tooth equipped with a regulating pin, using the toothbrush according to the present invention, FIG. 8 illustrates diagrammatically the operation of brushing with the aid of an interdental brush placed at the end of the handle of the brush opposite the brushing head.

FIGS. 7 and 8 show a plurality of regulating pins V attached to the dental crowns C and associated with metallic bands A.

The toothbrush 10, according to the present invention, comprises, in a manner which is in itself conventional, a handle 20 and a brushing head 30.

As shown in FIG. 2, the handle 20 is preferably non-rectilinear to permit easier access to the various surfaces of the dental crowns and to facilitate the brushing operations.

The handle 20 illustrated diagrammatically comprises a straight gripping portion 21 extended by a portion 22 which is likewise straight but is inclined relative to the above-mentioned portion 21 and which bears at its free end the brushing head 30.

What is illustrated by FIGS. 1 and 2 must not, however, be considered as limiting.

The various portions 21, 22 of the handle are advantageously symmetrical about a longitudinal median plane of the brush, given the reference P—P in the figures.

This longitudinal median plane P is perpendicular to the plane of FIG. 1 and parallel to the plane of FIG. 2.

According to the present invention, the brushing head 30 possesses, first, two lateral and longitudinal groups of tufts of soft bristles 31, 35, each of which comprise tufts inclined towards the outside of the brushing head, diverging relative to the median longitudinal plane P, and tufts converging towards this median longitudinal plane P, and secondly at least one central longitudinal row 40 of tufts of shorter bristles parallel to the median longitudinal plane P.

In even greater detail, according to the embodiment illustrated in the attached drawings, the brushing head 30 comprises a central longitudinal row 40 of tufts flanked on either side by lateral and longitudinal groups of tufts 31, 35, each distributed between two longitudinal rows, reference numerals 32, 33 for group 31 and reference numerals 36, 37 for group 35.

The tufts placed in the rows 33, 37 converge towards the median longitudinal plane P, whereas the tufts placed in the rows 32, 36 diverge relative to the median longitudinal plane P, these convergence and divergence occurring towards the free edge of the tufts.

The axes of all the tufts are preferably included within transverse planes (such as the sectional planes III—III and IV—IV) which extend perpendicularly to the median longitudinal plane P and to the mean plane of the surface 39 of the head bearing the bristles.

This surface 39 may of course itself be slightly rounded.

According to the present invention, which is non-limiting and is given by way of example:

the brushing head 30 possesses a width l of the order of 12 mm, the brushing head 30 possesses a thickness e of the order of 5 mm, the implantation surface of the bristles on the brushing head is substantially equivalent to the brushing surface, the length of the brushing head is of the order of 20 mm, the brushing head 30 comprises a central row 40 of tufts of bristles which extend perpendicularly to the support surface 39 of the head, possess a length of the order of 8 mm and have their axes merged with the median longitudinal plane P, the brushing head 30 further comprises on either side of the central row 40 lateral rows 32, 36 of tufts which diverge, departing from the median longitudinal plane P, and are inclined relative to the latter by an angle x of the order of 10°, these bristles having a length of 10 mm, the brushing head 30 finally comprises two external lateral rows 33, 37 of tufts which converge towards the median longitudinal plane P and are inclined relative to the latter by an angle y of 10°, these bristles likewise having a length of 10 mm, the interaxial distance between the central row 40 and the lateral rows 32, 36 is of the order of 2.5 mm, the interaxial distance between the lateral rows 32, 33; 36, 37 is of the order of 1.5 mm, each tuft of bristles is made up of about 45 soft bristles and has the form of a cylinder whose diameter is of the order of 1.5 mm.

It will be noted that the tufts of the lateral rows 32, 33; 36, 37 are implanted in staggered rows, that is to say are offset longitudinally from one row to the other in order to be able to intersect by virtue of their inclination, as illustrated in the figures.

As is illustrated in FIG. 7, the lateral rows of converging tufts 33, 37 make it possible to clean the junction between the bases of the dental pins or the edges of the dental rings. Between the teeth, these bristles of the rows 33 and 37 slip under the bands A and enable the proximal surfaces of the teeth to be cleaned.

Similarly, the diverging lateral rows of tufts 32, 36 brush the free edge of the teeth and the cervix, the axis of these tufts being such that their bristles can pass under the gum.

The tufts 40 brush the pins V and the bands A.

As is shown at the bottom of FIGS. 1 and 2, and also in FIGS. 5, 6 and 8, the end 23 of the handle opposite the brushing head 30 is preferably designed to carry, in a removable fashion, accessories 60, 70 which enable the cleaning operation to be perfected.

The accessories 60, 70 will be attached in a removable fashion to the end 23 of the handle, using any appropriate conventional means such as clip-on or bayonette means.

According to the form of embodiment shown in the figures, the end 23 of the handle comprises a through gap 50, made up of a central cylindrical perforation 51 into which run two diametrically opposed grooves 52, 53 of straight rectangular section.

Moreover, each of the accessories 60, 70 comprises a base 61, 71, which possesses a cylindrical stem 62, 72 complimentary to the perforation 51, and which bears at its free end a transverse bar 63, 73 complimentary to the grooves 52, 53.

The person skilled in the art will readily understand that in order to fix the accessories 60, 70 to the handle of the toothbrush 10, it is necessary to align the bars 63, 73 with the grooves 52, 53, then engage the bars 63, 73 and the stems 62, 72 in the gaps 50, then pivot the bases 61, 71 through a quarter-turn about the axis 64, 74 of the stems when the bars 63, 73 have passed through the gaps.

This pivoting may be limited by raised stops provided on the handle 20.

The length of the stems 62, 72 is preferably substantially identical to or less than the thickness m of the handle 20, in order to obtain immobilization of the accessories 60, 70 on the latter after the above-mentioned pivoting.

To facilitate this pivoting, while ensuring that the accessories 60, 70 are firmly immobilized, it is also possible to make provision for forming, on the handle 21, elastic projections intended to penetrate into indentations made on the bars 63, 73 or the bases 61, 71, or conversely to form elastic projections on the bars 63, 73 or the bases 61, 71 intended to penetrate into indentations made in the handles 21.

An interdental brush 60, comprising a brush 65 supported by the abovementioned base 61, is shown in FIG. 5.

This interdental brush 65 preferably possesses a generally frustoconical shape, tapering towards its free end. Nevertheless, a brush of generally cylindrical form may be used.

By way of non-limiting example, the interdental brush 65 may be made up, in a manner which is conventional in itself, of two central twisted metal wires which grip the strands of the brush. The active length of the interdental brush is, for example, 12 mm.

This interdental brush 65 is, in particular, designed to pass under the bands A, between the teeth, as shown in FIG. 8, to eliminate the bacterial plaque which adheres at these points, by a vertical movement M which is diagrammatically illustrated.

This interdental brush 65 likewise makes it possible to ensure brushing of the proximal surfaces of the teeth, particularly when the teeth are not contiguous, or after extractions.

A support for dental floss 70 is shown in FIG. 6.

The latter comprises a base 71 of general U shape.

More precisely, the central part 75 of the base possesses two parallel wings 76, 77 which are pierced at their free ends to receive a strand of floss 78 under tension.

This strand of floss 78 can be immobilized on the base 71 using any suitable conventional means, for example by simply winding it about the ends of the wings 76, 77 which, thanks to their resilience, hold the strand 78 under tension.

This strand 78 is intended to be passed between the teeth in the areas where there is no band A.

The present invention is not, of course, limited to the particular embodiment which has just been described, but extends to any alternative version which is in accordance with the spirit of the invention.

I claim:

1. Orthodontic toothbrush, particularly for children wearing regulating pins, characterized by a brushing head (30) comprising on the one hand two lateral and longitudinal groups of tufts of bristles (31,35), each group possessing tufts (32,36) inclined towards the outside of the brushing head and diverging relative to a median longitudinal plane (P) of the head, and tufts (33,37) converging towards this median longitudinal plane (P), and secondly at least one central longitudinal row of shorter tufts (40) parallel to the median longitudinal plane (P).

2. Toothbrush according to claim 1, characterized in that the difference in length between the bristles of the lateral groups (31,35) and the bristles of the central row (40) is substantially equal to the thickness of the regulating pins (V).

3. Toothbrush according to claim 1 characterized in that the difference in length between the bristles of the lateral groups (31,35) and the bristles of the central row (40) is of the order of 2 mm.

4. Toothbrush according to claim 1 characterized in that the axes of all the tufts (32,36, 33,37,40) are contained within transverse planes perpendicular to the said median longitudinal plane (P) and to the mean plane of the surface (39) of the head bearing the tufts.

5. Toothbrush according to claim 1 characterized in that each lateral group of tufts (31, 35) comprises two longitudinal rows of tufts (32,36; 33, and 37) which diverge and converge respectively relative to the median longitudinal plane (P) of the brushing head.

6. Toothbrush according to claim 1 characterized in that the inclination (x,y) of the tufts of the lateral groups (31,35) relative to the median longitudinal plane (P) is between 5° and 30° and preferably of the order of 10°.

7. Toothbrush accccrding to claim 1 characterized in that the end (23) of the handle (20) opposite to the brushing head (30) is designed to carry, in a removable fashion, accessories (50,60) for dental hygiene.

8. Toothbrush according to claim 7, characterized in that the end (23) of the handle (20) opposite to the brushing head (30) is designed to carry, in a removable fashion, an interdental brush (60).

9. Toothbrush according to claim 7, characterized in that the end (23) of the handle (20) opposite to the brushing head (30) is designed to carry, in a removable fashion, a support for dental floss (70).

10. Orthodontic toothbrush, in particular for children wearing regulating pins, according to claim 1, characterized by a brushing head (30) possessing, first, two lateral and longitudinal groups of tufts of bristles (31,35), each group being formed of two longitudinal rows of tufts (32,36; 33,37) which diverge and converge respectively relative to the median longitudinal plane (P) of the brushing head, the tufts of these lateral rows being implanted in staggered lines to intersect, and secondly a central longitudinal row of tufts of shorter bristles (40) parallel to the median longitudinal plane (P).

* * * * *